US008056855B2

(12) United States Patent
Konstantinovskiy

(10) Patent No.: US 8,056,855 B2
(45) Date of Patent: Nov. 15, 2011

(54) MISSILE INTERCEPTOR WITH NET BODY

(76) Inventor: Alexandr Konstantinovskiy, Kimry (RU)

( * ) Notice: Subject to any disclaimer, the term of this patent is extended or adjusted under 35 U.S.C. 154(b) by 421 days.

(21) Appl. No.: 12/134,168

(22) Filed: Jun. 5, 2008

(65) Prior Publication Data

US 2010/0102166 A1 Apr. 29, 2010

(51) Int. Cl.
*F41H 11/04* (2006.01)
*B64F 1/02* (2006.01)

(52) U.S. Cl. ..... 244/110 C; 89/36.17; 114/240 E

(58) Field of Classification Search ..... 244/1 TD, 244/110 C, 110 F; 89/36.01, 36.11, 36.17, 89/939; 114/14, 240 C, 240 E, 241; 102/405, 102/409

See application file for complete search history.

(56) References Cited

U.S. PATENT DOCUMENTS

| | | | | | |
|---|---|---|---|---|---|
| 1,173,463 | A | | 2/1916 | Reno | |
| 1,225,461 | A | * | 5/1917 | McCarthy | 102/409 |
| 1,271,864 | A | | 7/1918 | Digney | |
| 1,274,624 | A | * | 8/1918 | Steinmetz | 102/409 |
| 1,309,391 | A | | 7/1919 | Adkins | |
| 4,051,763 | A | * | 10/1977 | Thomanek | 89/36.17 |
| 4,262,595 | A | * | 4/1981 | Longerich | 102/402 |
| 4,768,417 | A | | 9/1988 | Wright | |
| 5,069,109 | A | | 12/1991 | Lavan | |
| 5,524,524 | A | * | 6/1996 | Richards et al. | 89/1.13 |

* cited by examiner

*Primary Examiner* — Rob Swiatek
(74) *Attorney, Agent, or Firm* — Alexey Bakman, Esq.

(57) ABSTRACT

The invention describes and claims an apparatus and method of missile interception. The missile interceptor comprises a net body with a plurality of sections and at least one missile trajectory effector. In the preferred variant, the missile trajectory effector is embodied as an exploding ring. A missile, passing through the net body, picks up a ring, which explodes once the missile passes a sufficient distance away from the missile interceptor. Preferred embodiments of the missile interceptor further comprise one or more vertically-positioned poles. Claimed method involves the use of such interceptor and positioning the interceptor on the likely trajectory of incoming missiles.

18 Claims, 6 Drawing Sheets

MISSILE INTERCEPTOR WITH NET BODY

FIELD OF THE INVENTION

The field of the present invention is missile-interception devices, and particularly a fundamentally new missile interceptor, comprising a net body.

BACKGROUND OF THE INVENTION

For decades, since the first implementation of the German V-2 rocket, billions upon billions of dollars have been spent on missile defense. Thousands of the greatest minds on both sides of the Atlantic pondered on devising impenetrable shields for missiles, and pondered on missiles that would penetrate these shields.

As cold war heated up, and radars, computers, and control stations evolutionized, much more complex, expensive and grand-scale anti-ballistic missile projects such as Nike-X, Sentinel, Safeguard, and Soviet A-35/135 developed. New missiles, with "multiple independently targetable reentry vehicle" (MIRV) warheads were employed to overcome these defenses. In response, the grand space-based science-fiction-bordering schemes, such as "Star Wars" of the 1980's or the "Brilliant Pebbles" of the 1990s came about. These gradually morphed into the current National Missile Defense project, involving the ground-based rocket-launched interceptors and radars. Countless funds and effort, both scientific and political, continue to flow into the Defense project and countermeasures to it.

By 2003 War in Iraq, United States and its allies, such as Israel were quite successful in developing highly functional, although expensive Patriot (PAC-3) and Arrow anti-ballistic missile systems. PAC-3 was even shown somewhat effective even against tactical ballistic missiles in the war in Iraq.

However, rockets with a shorter range than tactical ballistic missiles, such as rocket artillery, were not considered to be a particular threat on the modern battlefield. Although visually impressive, such rocket artillery is not very precise, not capable of sustained fire, and can be quickly overcome or neutralized on the battlefield by the greater and more technologically-advanced forces of Cold War superpowers and their allies.

As of early 21$^{st}$ century, it seemed that modern armies are quite familiar with and are quite advanced in the area of missile defense. But with the war on terrorism, the battlefield changed, virtually disappearing as a concept, and literally taking the most technologically-advanced armies back to step one in missile defense. After decades of tremendous investments into complex missile defense, the simplest of rockets, powered by fertilizer and sugar became one of the greatest threats to modern armies.

Mediocre in conventional battle, rocket artillery became a formidable weapon of asymmetrical warfare and terrorism—the modern kind of war. Small, hand-made from available materials and by medieval blacksmithing methods, the rockets and launchers are easily concealable, and are immeasurably cheaper, and simpler to operate than traditional cannon artillery. Lacking the precision of the cannon artillery, rockets retain comparable range and similar, or greater payload of explosives.

As military conflicts in Afghanistan, Iraq and Israel demonstrate, such combination of qualities, exhibited by rocket artillery, is quite deadly, particularly when rockets are launched at relatively short range or against "soft" targets, such as army barracks, infrastructure, storage depots, or densely-populated civilian areas, such as settlements or cities. And of course, the deadliness of such attacks can be greatly enhanced with unconventional loads, prohibited by international treaties, but fair game for terrorizing outlaws.

Simple rockets, such as Palestinian Qassams, require no time-and-labor-consuming installations. Nearly any covered area can be a launch site: a bush, a wall, a window in a residential building. Thus, the exact position of launch is unpredictable. Timing of launch is random. The rockets are small, light and fast. The distances are short. The crudeness of unstandardized, handmade, imperfect rockets, powered by uncontrolled, and often intermittent, nitrate-sugar reaction, make it impossible to calculate the likely trajectory of the rocket.

All of these factors make it nearly impossible for modern armies to prevent the launches of, or shoot down, these rockets. Even if it was technologically possible to shoot such a rocket down, it would require, often impossible, levels of 24/7 surveillance to detect the launch, and then the lightning coordination and speed in initiating the interception. Today it takes about 15 seconds for a launched Qassam rocket to travel from Gaza to the cities of Sderot or Askelon, in Israel. Even if interception was possible, the price of the equipment and of interception loads would exceed the cost of each incoming rocket thousands of times.

And there could be hundreds, thousands of rockets launched by the enemy in short amounts of time, dramatically multiplying already impossible efforts and odds of shooting them down. In 2006 Lebanon war, Israel was attacked by thousands of rockets launched by Hezbollah.

Some rocket types used by Hezbollah (and in use by numerous other terrorist organizations and "rogue states"), such as Chinese or Russian made Katyusha and Grad systems, are capable of launching barrages of tens of short-range missiles nearly simultaneously. Any attempt to intercept such a barrage of missiles, using existing conventional high-tech interception means, such as shooting them down individually is doomed to failure.

The most up-to-date missile-defense approach, utilized for rocket artillery and tactical ballistic missiles is "duck and cover." In fact, Israel, the country with one of the most technologically-advanced militaries and missile-defense and notification systems in the world, has recently resorted to erecting cement walls in its cities. When air alarm sounds, giving a 10-15 second warning of the incoming rocket, citizens are supposed to "duck and cover" near such walls. Some organizations, such as schools resort to other primitive and ineffective means of protection, such as installing steel plates on the roofs. Needless to say, such means provide little physical or psychological protection from missiles and the terror they bring.

Similarly, there is little to no defense from another type of rocket—the cruise missile. While technologically complex, cruise missiles imitate simple, low-flying projectiles. Frequently, cruise missiles travel at heights, barely above treetops. At such a low height, cruise missiles avoid detection by most radar systems. Virtually undetectable, and uninterceptable by modern means, cruise missile strikes when the target is most unprepared and vulnerable, leading to the greatest amount of damage and casualties.

This element of surprise and the near lack of countermeasures for cruise missiles, terrorist-launched rocket artillery and other low-flying missiles makes them one of the greatest threats for modern armies. A US military outpost, positioned abroad, or an Israeli settlement, can build high concrete walls, install electrified gates and put armed guards along perimeter to guard against suicide bombers and guerilla attacks. But no cement wall can practically be erected high enough or be resilient enough against a rocket. And no amount of surveillance, and no active high-tech means provide reliable protection against such attack.

In light of the problems associated with traditional missile defense methods and limitations associated with prior art devices, there is a long-standing and unsatisfied need in the art for a missile shield, or a missile defense system, which would effectively neutralize low-flying missiles and could be engaged 24 hours a day, 7 days a week, or be engageable within seconds.

Present invention provides a special missile-interceptor net device and a method of using nets for low-flying missile interception. Nets have been used in warfare for centuries to entangle the enemies or fence-off borders and military positions. Camouflaging nets are common. Explosive nets have been used with some success in anti-submarine and anti-personnel warfare. However, rapidly-deployable or permanently deployed net, specifically designed to shield a specific sensitive area against incoming missiles is urgently needed by US armed forces stationed in hostile environments, such as Iraq and Afghanistan and civilians such as those in Israeli cities, bombarded by thousands of Quassam rockets every year. Such nets are also urgently needed for protection of border installations and refugee camps under the threat of rocket attack, such as those in Dafur region of Africa, as well as in multitude of other locations around the world.

Ideally such net would be simple to deploy, inexpensive in maintenance and production, capable of withstanding the winds, moisture, and other rigors of long-term outdoor deployment, and unlike anti-personnel and anti-submarine explosive nets, it must have the capability of surviving an interception of single or multiple rockets mostly intact, ready for another immediate interception. The latter is particularly important for intercepting barrages of missiles, such as those fired from Katyusha and Grad systems. The present invention achieves all of these objectives and provides numerous additional benefits.

SUMMARY OF THE PRESENT INVENTION

The present invention is defined by the following claims and nothing in this section should be taken as a limitation on those claims.

The invention describes and claims an apparatus and method of missile interception. The missile interceptor of the present invention comprises a net body. The net body in turn comprises a plurality of sections and at least one missile trajectory effector. The preferred embodiments of the invention comprise a plurality of missile trajectory effectors, each of which comprises an explosive substance. In one of the embodiments, the missile trajectory effectors are embodied as exploding rings. Some embodiments of the missile interceptor further comprise at least one vertically-positioned pole, said at least one vertically-positioned pole holding the missile interception net extended along the plane that is generally perpendicular to the likely trajectory of incoming missiles. The net body may be attached to these poles via the tilt assembly and/or the height-adjustment assembly, said assemblies allowing for adjustments of the position of the net body, so that to the extent possible, the net body is positioned on a likely trajectory of incoming missiles. The method of using the missile interceptor to intercept incoming missiles is also described and claimed.

DETAILED DESCRIPTION OF THE PREFERRED EMBODIMENT

Figure 1:
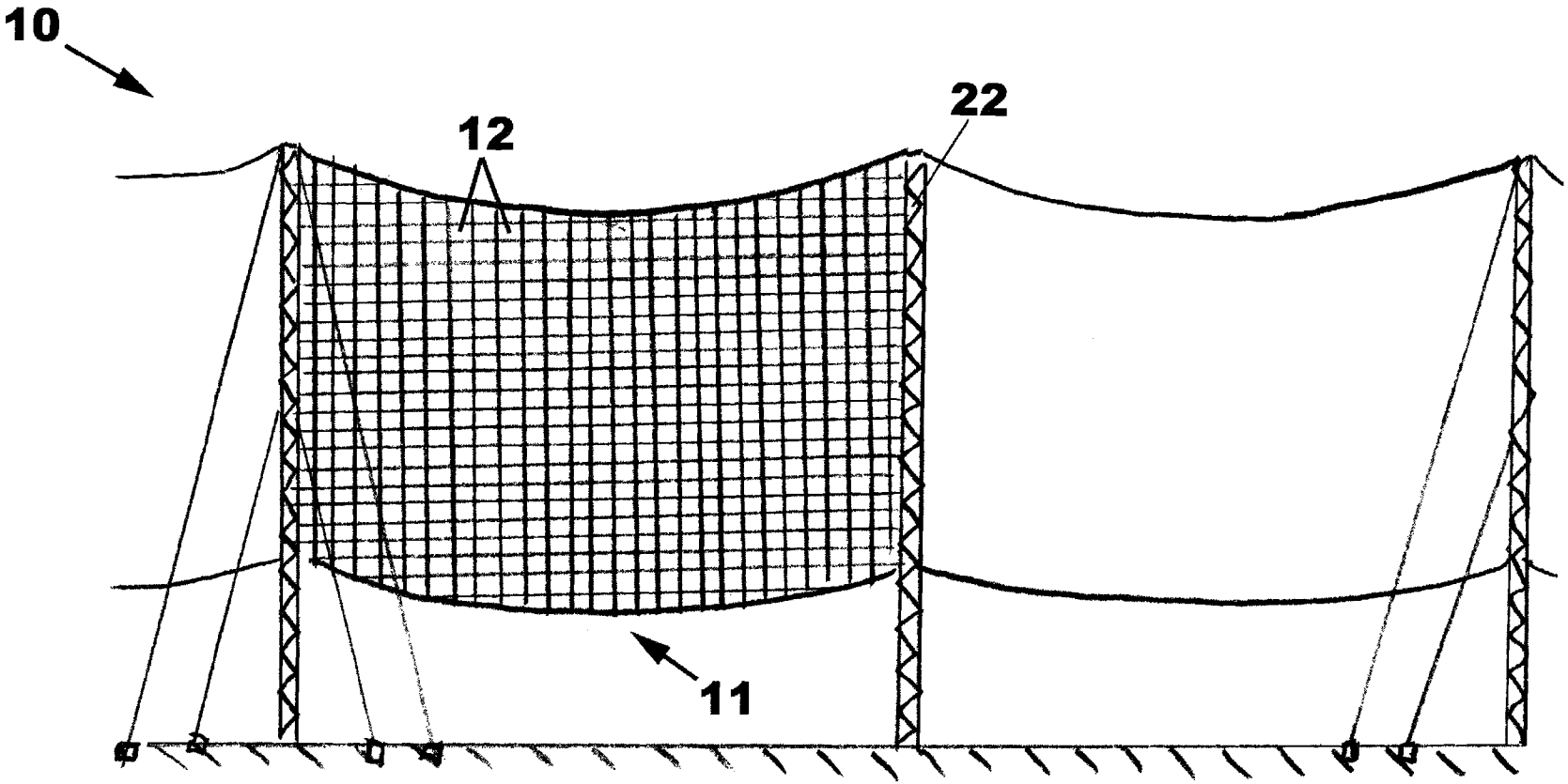
FIG. 1 is the front side view of the missile interceptor of the present invention.

The apparatus of the present invention will now be illustrated by reference to the accompanying drawings. Preferred embodiments of the missile interceptor of the present invention ("the interceptor") have been assigned reference numeral 10. Other elements have been assigned the reference numerals referred to below.

The device 10 of the present invention comprises a net body 11, otherwise referred to as "the net" 11. The net body 11 is comprised of a plurality of sections 12, wherein each section 12 is a mesh of this net (otherwise referred to as mesh 12). Just like in any other net, each mesh 12 is connected to or shares the edge with at least one other neighboring mesh 12. The neighboring meshes may be interwoven or otherwise connected to each other to form a flat interconnected structure (i.e. a net.).

In the simplest and preferred embodiment of the invention, sections 12 are rectangular and are formed by the intersection of horizontal 15 and vertical 17 lines that make up the structure of the net 11. In such a simple embodiment, each section 12, other than the sections 12 located at the edges of the net 11 shares four of its sides with four other adjacent sections 12. In other, more complex embodiments, the weave of the net may be different and, accordingly, the shape of the meshes 12, or sections 12 will be different.

The term "line," as used in this description is a broad term, intended to encompass numerous materials or combinations thereof suitable for making nets. As the mesh will be deployed outside, such materials should be resistant to weather extremes and wear, and be light and strong enough to form and support a very large net. Some lightweight and strong suitable materials include synthetic fibers, such as braided Kevlar and Spectra. Since the net may be exposed to rocket exhaust and explosions, heat resistant materials are also appropriate.

The light weight of the lines making up the net 11 is of importance, when the net is mobile or adjustable, as discussed below. For permanent or semi-permanent installations of the net 11, heavier and stronger lines, such as the ones made from steel rope or wire, may be used.

In the preferred embodiment of the interceptor 10, the vertical lines 17 of the net 11 are of different strength than the horizontal 15 lines. Preferably, the vertical lines 17 of the net 11 are stronger than the horizontal lines 15. For example, the vertical lines 17 can be made thicker or of different (lighter) material than the horizontal lines 15. Greater thickness of the vertical lines 17 is preferable, since the net 11 is likely to be positioned vertically or mostly vertically in most circumstances. Thus, much of the weight of the net 11 will be transferred to the vertical lines 17, which must be strong enough to bear this weight for extended amounts of time without tearing or sagging. At the same time, lighter weight of the horizontal lines 15 will reduce the load on vertical lines 17 and lighten the entire construction, allowing for larger size and simpler deployment.

Furthermore, it is likely that a rocket, hitting the interceptor will tear up one or more of the sections 12 of the net 11. In this case, a horizontal line 15, if it's thinner, is more likely to be torn. This tearing of the horizontal line 15 is preferable to the tearing of the weight-bearing vertical line 17, and would allow most of the structure of the net 11 to survive for interception of subsequent rockets.

The net 11 comprises one or more missile trajectory effectors 14. In the preferred embodiment, each section 12 comprises at least one missile trajectory effector 14. The term "missile trajectory effector" is a broad term, referring to a multitude of adaptations which could affect a passing missile's effectiveness by either changing the trajectory or destroying the missile. In some embodiments of the present invention, the missile trajectory effector can be as simple as one or several metallic spikes or other structures, extending into each section 12, said spikes or structures intended to detonate, damage, knock, or otherwise affect the missile as it passes through the section 12. In some more complex embodiments, and for some missile types, the missile trajectory effector acts by creating a magnetic, heat, or other field in the vicinity of each section 12, as the missile is passing through, thus disabling the explosives in the warhead or jamming the electronics of the missile without physically destroying it or directly affecting the trajectory. Several types of missile trajectory effectors 14 may be combined on one interceptor 10 for maximum effect on each missile or for effecting different types of missiles.

In the preferred embodiments, however, the missile trajectory effectors 14 effect the missile with an explosion. This is the preferred method, as explosives are generally inexpensive, effective against most types of missiles and do not require great precision. Thus, in the preferred embodiments of the invention, at least some, or (preferably) all of the missile trajectory effectors 14 comprise an explosive substance 16. Plastic explosives are preferred for use as explosive substance 16. However, numerous other types of explosives, well known to those skilled in the art may be used. In some embodiments of the invention, sheer impact of the missile against the trajectory effector 14 and/or and explosive substance 16 is sufficient to detonate the explosive substance 16.

Some embodiments of the interceptor 10 further comprise an explosion activator device. The explosion activator device is the device that triggers the explosion of the explosive substance 16. An explosion activator device may comprise sensing equipment for detecting the presence of the missile in the vicinity. For example, in some embodiments, an explosion activator device may be activated by a physical impact, an interruption of electric current (by ripping of thin cables, for example) or interruption of a field (such as a magnetic field), caused by a passing missile. The explosive substance 16 may be contained inside or outside of the explosion activator device.

In the preferred embodiments, each explosion activator device is comprised exclusively of (or, in other embodiments, comprises in addition to other elements) one or more rings 20. Each ring 20 is detachably connected to one of the sections 12, so as to separate from the section 12 upon the passing of a missile through the net 11. The ring 20 preferably has the same or slightly smaller perimeter than that of section 12, although the size of the ring 20 depends on the size and structure of the rocket likely to be intercepted. In the preferred embodiment, the diameter of the ring is slightly wider than the body of the missile, expected for interception. Thus, as the rocket enters warhead-first into one of the sections 12 of the net 11, it also enters into a detachable ring 20, associated with that section. In other words, the (usually pointed) head of the rocket threads the ring 20 onto the rearwardly expanding body of the rocket. If the diameter of the rocket's body is larger that that of the ring 20, then, as the rocket moves through the ring 20, the ring 20 would seat/attach itself on the warhead of the rocket. If the diameter of the rocket's body is smaller than the ring 20, then the body of the rocket is likely to partially pass through the ring 20, catching the ring 20 with wings or tail fins of the rocket (See FIG. 2). As the rocket/missile continues to move forward, the ring 20 detaches from the section 12 and travels with the missile, ringing the missile.

While in some embodiments of the net 11, the explosion activator device is triggered to cause an explosion upon immediate contact with the missile, the embodiments comprising the ring 20 allow delay of the explosion for a brief time in which the rocket passes through and away from the net 11. In preferred variations of the net 11, each ring 20 comprises the explosive substance 16. As the missile, ringed with a ring 20 moves sufficiently away from the net 11, the explosive substance 16 of ring 20 explodes on or around the missile. Such an explosion need not be extremely powerful to destroy the missile in-flight and even relatively small amounts of explosives are likely to be effective. However, the detonation of the explosive substance 16 will in most cases trigger the detonation of the missile's warhead and/or fuel contained within the missile, resulting in powerful explosions. That is why it is important that the ring 20 explodes with a delay, when the ringed missile travels sufficiently far from the net. This way, the explosion of the missile will not damage the net 11 directly or by causing the detonation of the remaining explosive substance 16, still attached to the net 11. Thus, while the intercepted missile may damage one or even several adjacent sections 12, while passing through the net 11, most of the net 11 will remain intact for interception of subsequent missile attacks or other missiles in a barrage.

The controlled delay in the explosion of the ring 20 can be achieved in a number of ways, well known to those in the art of explosives. One way to achieve the delay is by the use of an explosion delay element 21 as part of each ring 20 (or part of any other type of missile trajectory effector 14). The explosion delay element 21 can take many forms. For example, once the ring 20 is torn away from the section 12, a thin cable or a thread of predetermined length may continue to connect the ring 12 and the net 11 (See FIG. 2). Once the thread is pulled tight or ripped out of the ring, the explosive substance 16 is detonated. Alternatively and preferably, the explosion delay element 21 of the ring 20 is internal, and of the same type, action and structure as that commonly used on hand grenades, with the event of disconnection of the ring 20 from the net 11 starting the same sequence of events as pulling of a ring on a hand grenade. That is, in preferred embodiments, it allows for detonation of the primer. The primer explodes and ignites the fuse (i.e. the delay element), the fuse burns down and activates the detonator which explodes the main charge (the explosive substance 16), thus destroying the missile.

Figure 3:
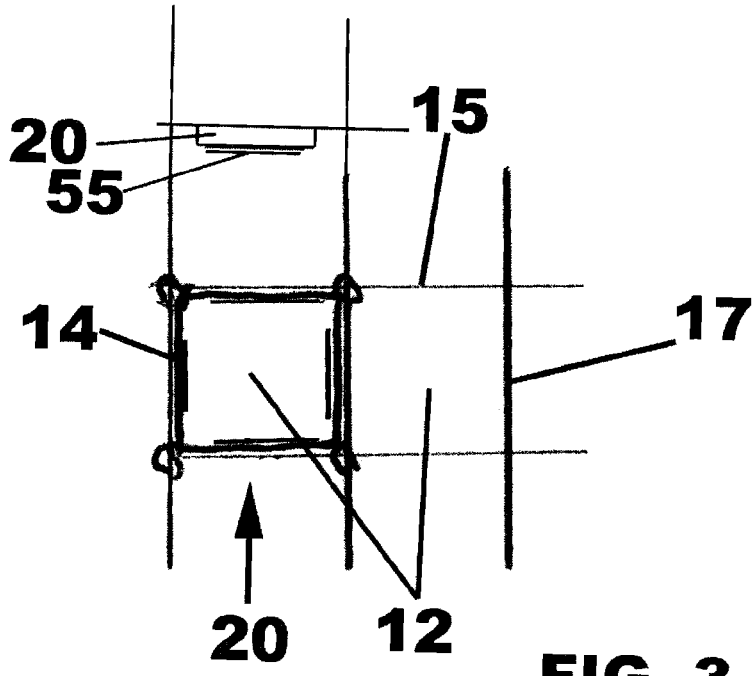
FIG. 3 is the close-up view of several sections of the net body, illustrating, among other things, two different types of rings.

It should be noted that the term "ring" as used in describing the ring 20 is a broad term for a device of any form and structure that attaches to the passing missile. For example, in some embodiments a ring may be an explosive device of any shape and form that attaches to any part (including one side of the body) of the passing missile with a magnet, or some other attachment method, instead of seating itself around the missile body. See FIG. 3 for illustration of an embodiment where the ring 20 is box-shaped and comprises a magnet 55. The term was selected for ease of visualization of a missile being "ringed" by a ring, a loop, or a self-tightening nooze. Such circular rings, loops, or nooses may be used in some embodiments of the net 11. In the preferred embodiment, however, the ring 20 is of rectangular shape, such as the lower ring 20 of FIG. 3. This way, if the ring 20 is attached to the rectangularly shaped and similarly-sized section 12, there will be no open spaces on the net where the warhead of the rocket may go, without getting into the ring 20. In general, in embodiments where the ring 20 is attached on top of the section 12 or mesh 12, it is preferable that the shape and size of the mesh 12 and the ring 20 be roughly the same. Alternatively, each section 12 may comprise several rings 20 of similar or varying shape, covering the area of section 12.

In some preferred embodiments, ring 20 comprises a core (an inner explosive core). This core is comprised exclusively of, or comprises, in addition to other elements, the explosive substance 16. The inner explosive core is covered with a layer of braided rope 102. The rope can be a nylon rope, or any other kind of rope. The length of the braided rope, with the explosive substance 16 inside the braid, is then shaped into a ring (circular, square, or of any other shape). In other words, in such embodiments, explosive substance 16 is hidden inside the ring of braided rope. The braided rope preferably forms the outer surface of such rings 20. Some flexibility and friction inherent in a ring with an outer surface made out of the braided rope will allow such a ring to have a tight friction fit on the surface of the missile. Of course, not all embodiments of rings 20 comprise inner explosive core, and in ones that do, the inner explosive core may be covered by substances other than braided rope.

Figure 4:
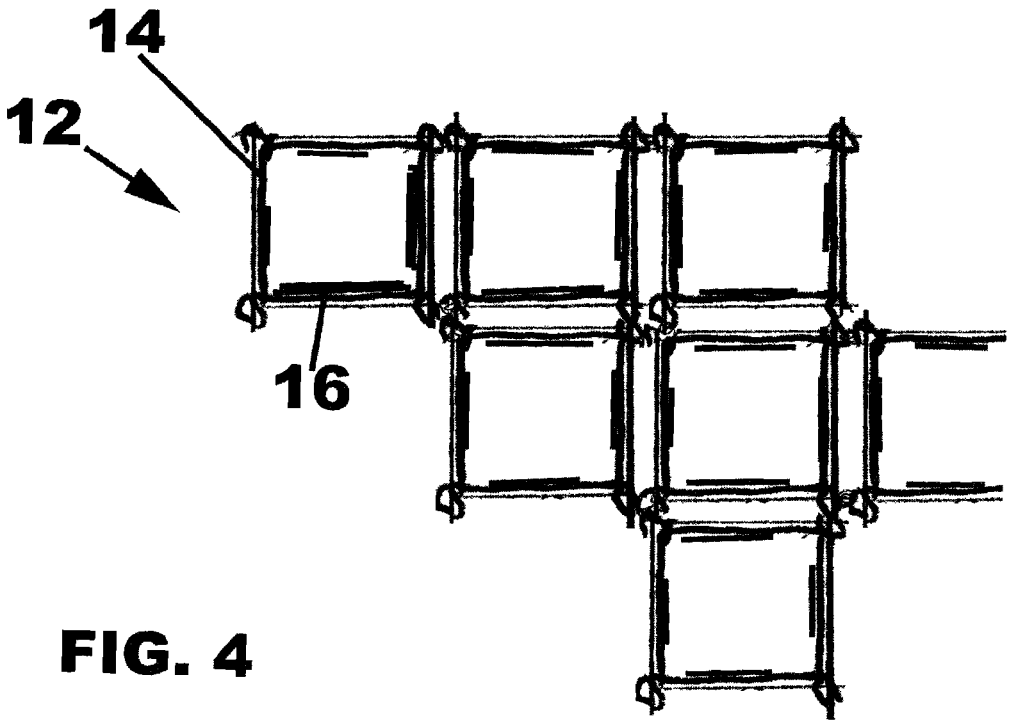
FIG. 4 illustrates, among other things, the close-up view of the embodiment of the missile interceptor of the present invention comprised entirely of rings 20, without any backing of vertical and horizontal lines.

Present invention foresees the embodiments where the net 11 may be comprised entirely of rings 20, without any additional backing of vertical and/or horizontal lines (FIG. 4). In such embodiments, each section 12 comprises a ring 20, which ring 20 is simultaneously a missile trajectory effector 14. In such embodiments, every ring 20 is detachably connected to the neighboring rings in such a way that it can be torn out by the rocket without destroying the integrity of the rest of the net 11.

Figure 2:
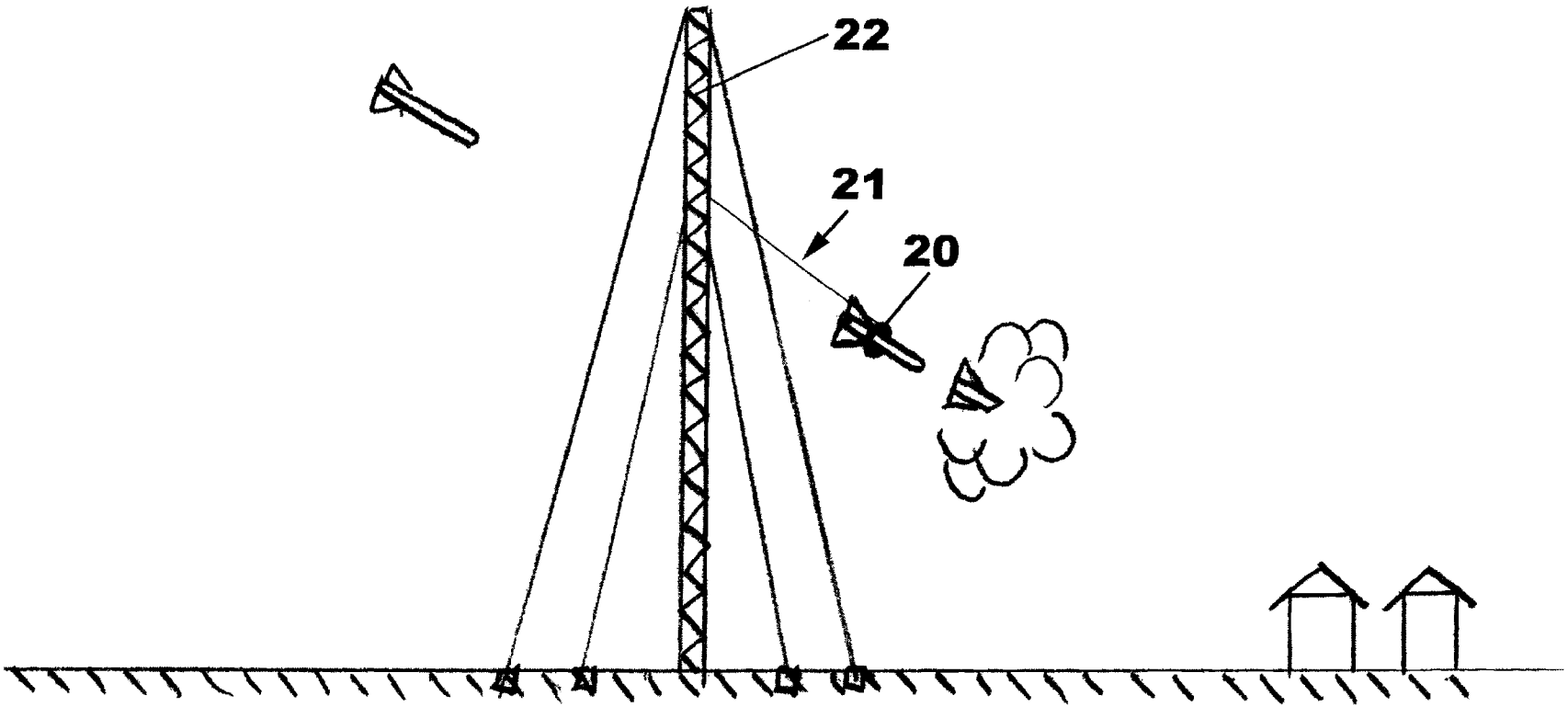
FIG. 2 is the right side view of the preferred embodiment of the missile interceptor of the present invention, illustrating, among other things, the missile interceptor in action.

The method for proper deployment and use of the net 11 requires positioning the missile interception net 11 on the likely trajectory of incoming missiles, as shown on FIG. 2. For maximum efficiency, the net should be unfolded to the full extent to cover the broadest possible area, and positioned in such a way that the plane of the net 11 is generally perpendicular to the incoming missile's path. It is not necessary that the plane of the net 11 be exactly perpendicular to the rocket's path. In fact, most embodiments of the invention should be functional in intercepting missiles coming in at considerable angles to the plane of the net 11. However, the closer the rocket's horizontal and vertical approach angles are to being perpendicular to the surface of the net 10, the greater is the chance that the rocket will hit the net, properly interact with missile trajectory effectors 14, and in preferred embodiments, explode at a preset distance from the net.

In simpler embodiments of the invention, the net 11 is installed unfolded at a preset position and angle. Such installation is particularly suitable for situations where the potential target of attack is stationary, and where the potential location of rocket launch is predictable. Such is the situation in settlements or at military bases located near enemy borders. For example, residents of Israeli border towns, can currently anticipate the location of potential launches of Palestinian missiles and even their approximate trajectory. Thus, if, for example, a protection was required for a school in a particular town, one or several nets 10 could be permanently installed at some distance from and/or above the school, at locations where the missile is likely to pass on the way to the target.

It is also important to note, that in situations where the missile launch sites are known, and particularly where the potential targets are known as well, the interceptor 10 may be installed in such a way as to prevent the launch of rockets from a certain position. For example, if army command knows that a military installation is being frequently attacked from a certain building, the net 11 may be stretched over or in the vicinity of such building (in addition to or instead of being installed near the target), so that the net 11 is in the path of rockets launched upward from that building.

Figure 5:
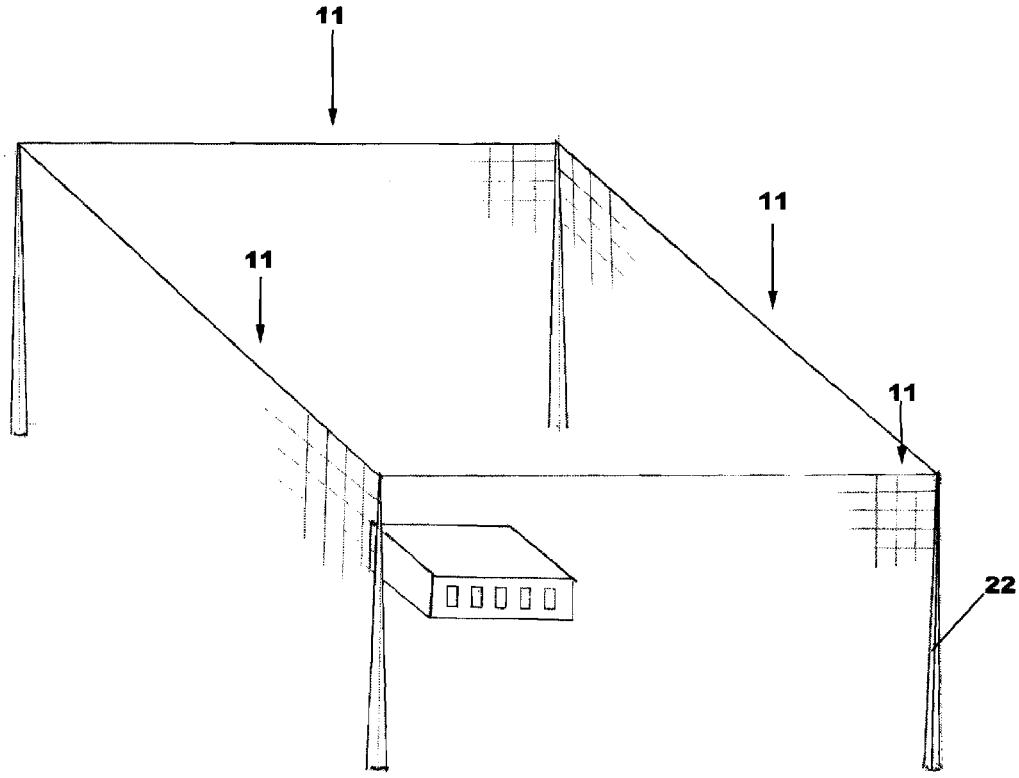
FIG. 5 illustrates, among other things, the method of protecting a potential target by positioning the missile interceptors of the current invention on several sides of the target.

The net 11 can be installed/stretched between any two tall rigid structures, such a between two tall buildings to protect the street below from rocket attacks. In most cases, however it is most practical to suspend the net between a pole 22 and a structure, or two or more poles 22, specifically provided for this purpose. In cases where the rocket-launching position is unpredictable (such as in cases of military positions on occupied enemy territory), several nets 10 can be installed around the potential target (See FIG. 5). Alternatively, a single net 11 can be "wrapped" around several poles 22 surrounding the target. This way, even though the plane of the net 11 is not entirely perpendicular to the path of the potential missile, some of its sections are always perpendicular to a rocket fired from any particular direction.

When the size of the missile is unpredictable, several layers of nets 10, with progressively smaller mesh diameter may be installed. For example, the net 11 acting as the first layer of protection may be have the largest mesh and powerful explosive loads, aimed at disabling a cruise missile coming in horizontally, while the net 11 acting as the second layer may have a smaller mesh, and be positioned behind the first net. The second net, if aimed at shorter-range missiles may also be positioned higher and with a slight vertical tilt (FIG. 7) to present a plane perpendicular to the missiles coming at an angle from above.

In most situations, it is preferable that poles 22 be as tall as possible to allow for taller/larger sizes of net 11 to be deployed and for interception of missiles coming in at an angle from above. The term "Pole" as used in this description refers to one or more tall, vertically-positioned structures, performing the role of holding the body 11 of the net 11 extended along the plane generally (i.e. roughly) perpendicular to the likely trajectory of incoming missiles. Pole 22 can be a simple long stick or a complex tall structure, akin, for example, to the high-voltage line towers.

Simple, stick-like poles 22, hundreds of meters high can be easily transported in pieces, assembled on the spot and installed and secured with anchoring cords or counterweights.

Figure 6:
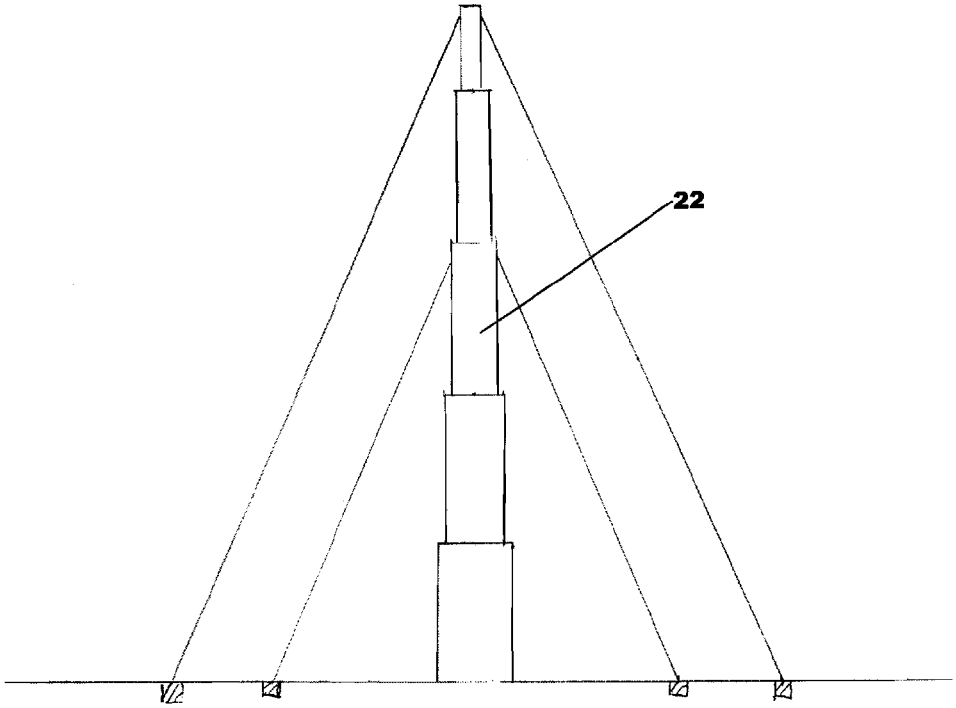
FIG. 6 illustrates the telescopic pole of the type used in some of the preferred embodiments of the missile interceptor of the present invention.

Some of the preferred embodiments of the invention comprise adaptations for adjusting the position of the net 11, in response to the threat. For example, the poles 22 may be telescopic, with progressively thinner sections towards the top of the pole 22 fitting into the wider sections towards the bottom (See FIG. 6). Such a pole 22 can be made extendable or contractible by a variety of methods well known to those skilled in the art. One way to extend and contract such poles 22 quickly and efficiently is through the use of electrical, pneumatic, or hydraulic motors positioned inside or on the pole 22. Such an adjustable pole can be used to quickly raise the net 11 into position when there is a threat of attack and lower it away from public view when the threat recedes.

Similarly, the compactness of the telescopic poles 22 allows for concealed installation of the net 11 near secret or sensitive military positions, such as ICBM launch pads. The net 11 or multiple nets 10, attached to the telescopic poles 22 can be positioned underground, around the military installation. If there is a reported threat, such as an approaching cruise missile, the rapidly-extending poles can in seconds raise the nets 10 into positions of appropriate adjustable height (depending on circumstances) around and above the potential target, guarding against the direct hit.

As discussed in the background section, supra, modern missile warning systems, do not provide sufficient warning to reliably intercept the missile using traditional interception methods. However, they do provide some warning and general feedback about the incoming missile, currently giving the residents of Israeli border towns the 15 seconds to duck and cover. And while the exact trajectory of the missile can not be calculated, the approximate trajectory can be. And this approximate trajectory is sufficient for an imprecise interceptor, such as the net 11. Ten to fifteen seconds since rocket's launch are an ample amount of time for powered telescopic poles to adjust the position of the net 11 to appropriate height for incoming missile interception.

A variety of types of height-adjustment assemblies 23 may be used in addition to (or instead of) the preferred telescopic function of the poles 22 (See FIG. 6) to raise the net 11 to appropriate interception height. Thus, for example, in some embodiments, the poles 22 comprise toothed guides, extending the most of the length from top to bottom of the poles 22. One or more toothed wheel, attached to the net 11, rolls along these guides, raising or lowering the net 11 to the desired height.

Figure 7:
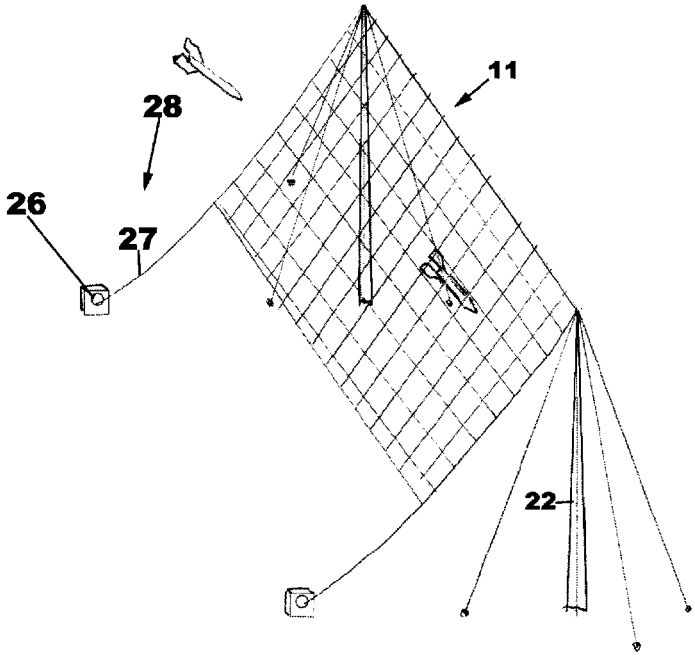
FIG. 7 illustrates, among other things, the use of the tilt assembly on one of the preferred embodiments of the missile interceptor of the present invention.
Figure 8:
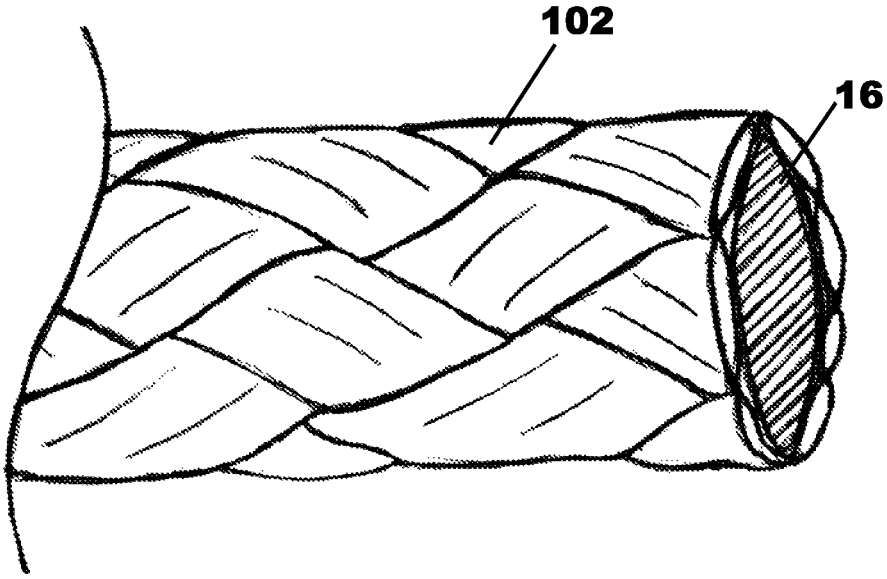
FIG. 8 illustrates a perspective view of the cross-section of the ring, said ring comprising an explosive core covered with at least one layer of braided rope.

In the preferred embodiments of the invention the net 11 further comprises a tilt assembly 28, connected to and supporting the net body 11. The term tilt assembly 28 refers to a variety of different adaptations intended to adjust the vertical angle/slant of the net 11. Such an adjustment is useful for positioning the vertical axis of the net perpendicularly to the missile's path, as shown in FIG. 7. There is a number of ways, apparent to those skilled in engineering arts, that a tilt assembly 28 may be constructed and implemented. In the preferred embodiment shown on FIG. 7, a simple tilt assembly 28 is implemented, comprising several winches/hoists 26 and a plurality of tilt adjustment ropes 27 connected to the lower end of the net 11. As winches 26 take up the rope, the angle of the net changes. The position of winches and the length of rope may vary, allowing for nearly horizontal angles of the net 11, if the winches are far and the rope is sufficiently long. Similar winches may be used to hoist the net 11 up and down the poles 22, in a way similar to hoisting a flag.

Of course, in other embodiments of the interceptor 10, the height-adjustment assembly and the tilt assembly may be implemented in a number of different ways. The height and rotation of the net 11 may be adjusted by the motors at great speed. Similarly, the poles themselves may be movable, positioned on rails, for example, and allowing for horizontal transport of the net 11, in response to the threat.

In some preferred embodiments, the height adjustment assembly 23 and the tilt-adjustment assembly 28 adjust the net in response to the computer-generated signal. That is, following the detection of the missile launch, the computer/electronic systems calculate the likely trajectory of the missile and adjust the position of the net body 11 in accordance with these calculations.

It is to be understood that while the apparatus and method of this invention have been described and illustrated in detail, the above-described embodiments are simply illustrative of the principles of the invention and the forms that the invention can take, and not a definition of the invention. It is to be understood also that various other modifications and changes may be devised by those skilled in the art which will embody the principles of the invention and fall within the spirit and scope thereof. It is not desired to limit the invention to the exact construction and operation shown and described. The spirit and scope of this invention are limited only by the spirit and scope of the following claims.

I claim:

1. A missile interceptor comprising:

a net body, said net body comprising:

a. a plurality of sections, b. at least one missile trajectory effector, c. and further comprising at least one explosion activator device, said at least one explosion activator device comprising sensing equipment, said at least one explosion activator device physically connected to the net body.

2. The missile interceptor of claim 1, wherein the net body is positioned on a likely trajectory of incoming missiles.

3. The missile interceptor of claim 1, comprising a plurality of missile trajectory effectors, wherein at least some of the plurality of the missile trajectory effectors comprise an explosive substance.

4. The missile interceptor of claim 3 wherein each section of the plurality of sections comprises at least one missile trajectory effector.

5. The missile interceptor of claim 4 wherein the explosive substance is plastic explosive.

6. The missile interceptor net of claim 4 wherein each missile trajectory effector comprises an explosion delay element.

7. The missile interceptor of claim 3, further comprising a plurality of rings, said plurality of rings being detachably connected to the net body.

8. The missile interceptor of claim 7, wherein each ring of the plurality of rings comprises a core, said core comprising the explosive substance, and wherein said core is covered with at least one layer of braided rope.

9. The missile interceptor of claim 3, further comprising a tilt assembly.

10. The missile interceptor of claim 3, further comprising a height-adjustment assembly.

11. The missile interceptor of claim 1, wherein the net body comprises vertical lines and horizontal lines, and wherein the vertical lines are stronger than the horizontal lines.

12. The missile interceptor of claim 1, further comprising at least one vertically-positioned pole, said one or more vertically-positioned pole holding the net body extended along the plane that is generally perpendicular to the likely trajectory of incoming missiles.

13. A missile interceptor comprising:

a net body, said net body comprising:

a. a plurality of rings, wherein each ring of the plurality of rings is detachably connected to the net body, and wherein each ring of the plurality of rings comprises an explosive substance and an explosion delay element.

14. The missile interceptor of claim 13, wherein each ring of the plurality of rings is detachably connected to at least one other ring of the plurality of rings;

the missile interceptor further comprising one or more vertically-positioned poles, said one or more vertically-positioned poles intended for holding the net body positioned on a likely trajectory of incoming missiles, and extended along the plane that is generally perpendicular to the likely trajectory of incoming missile.

15. Method of missile interception, comprising the steps of a. providing a missile interceptor of the type comprising a net body, said net body comprising:

i. a plurality of sections, ii. at least one missile trajectory effector, iii. a plurality of rings and further comprising at least one explosion activator device, said at least one explosion activator device comprising sensing equipment, said at least one explosion activator device physically connected to the net body;

b. positioning the net body on a likely trajectory of incoming missile.

16. The method of claim 15, further comprising the step of positioning the net body along the plane that is generally perpendicular to the likely trajectory of the incoming missile.

17. The method of claim 15, further comprising the steps of calculating the likely trajectory of a missile after the missile's launch and subsequently adjusting the position of the net body in accordance with these calculations.

18. The method of claim 15, further comprising the step of positioning a plurality of the missile interceptors on all sides of a potential target.

* * * * *